US011610744B2

(12) United States Patent
van Dijk et al.

(10) Patent No.: US 11,610,744 B2
(45) Date of Patent: Mar. 21, 2023

(54) SWITCH HAVING A POSITION INDICATOR

(71) Applicant: Eaton Intelligent Power Limited, Dublin (IE)

(72) Inventors: Marcel van Dijk, Enschede (NL); Adri Lammers, Hengelo (NL); Dinant Heilersig, Markelo (NL)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/541,318

(22) Filed: Dec. 3, 2021

(65) Prior Publication Data

US 2022/0181097 A1 Jun. 9, 2022

(30) Foreign Application Priority Data

Dec. 8, 2020 (GB) ..... 2019261

(51) Int. Cl.
*H01H 9/16* (2006.01)
*H01H 33/662* (2006.01)
*H01H 33/666* (2006.01)

(52) U.S. Cl.
CPC ..... *H01H 9/16* (2013.01); *H01H 33/6664* (2013.01); *H01H 33/66207* (2013.01)

(58) Field of Classification Search
CPC .... H01H 9/16; H01H 9/18; H01H 2009/0292; H01H 33/66207; H01H 33/6664; H01H 33/6661; H01H 33/121; H01H 33/66; H01H 33/122; H01H 71/04; H01H 19/38
USPC .... 200/308, 554, 14, 16 F, 48 KB; 218/4, 5, 218/6, 12, 55, 69, 70, 80, 100
See application file for complete search history.

(56) References Cited

U.S. PATENT DOCUMENTS 7,579,571 B2 * 8/2009 Siebens ..... H01H 33/66207 218/120
7,579,572 B2 * 8/2009 Stepniak ..... H01H 33/02 218/155
8,973,519 B2 * 3/2015 Bindics ..... H01H 9/16 116/285
9,216,527 B2 * 12/2015 Martin ..... H01H 33/662
9,343,881 B2 * 5/2016 Hyrenbach ..... H02B 13/045
(Continued)

FOREIGN PATENT DOCUMENTS

CN 104252998 A 12/2014
EP 1863053 A1 12/2007
GB 690495 A 4/1953

*Primary Examiner* — William A Bolton
(74) *Attorney, Agent, or Firm* — Leydig; Voit & Mayer, Ltd.

(57) ABSTRACT

A switch for medium voltage applications is provided. The switch comprises a vacuum interrupter having a fixed contact, a movable contact movable in a first direction to and away from the fixed contact between a closed position and an open position, and a drive rod arranged to the movable contact for moving the contact between the closed position and the open position. The switch further comprises a changeover switch having a first terminal body, a second terminal body, an elongated pole body, and an operating rod. The elongate pole body is hinged with a first end to the first terminal body and rotatable between a connected position in which the second end of the pole body is in direct electrical contact with the second terminal body and a disconnected position in which the second end is disconnected from the second terminal body.

4 Claims, 5 Drawing Sheets

(56) References Cited

U.S. PATENT DOCUMENTS

| | | | | |
|---|---|---|---|---|
| 9,685,283 | B2 * | 6/2017 | Darko | H01H 9/24 |
| 2017/0018381 | A1 * | 1/2017 | Abrahamsen | H01H 33/6661 |

* cited by examiner

SWITCH HAVING A POSITION INDICATOR

CROSS-REFERENCE TO PRIOR APPLICATION

Priority is claimed to British Patent Application No. GB 2019261.3, filed on Dec. 8, 2020, the entire disclosure of which is hereby incorporated by reference herein.

FIELD

The invention relates to a switch for medium voltage applications.

BACKGROUND

The position of such a switch is dependent on the position of the vacuum interrupter and the position of the changeover switch. Especially with switches in medium voltage applications, it is desired for people working with this switchgear, such as maintenance personnel, that they are certain in which position the switch is. Although, the control panel of switchgear provides an indication of the position of the switch, it is preferred to be able to visually inspect the switch, such that it can be ascertained that the vacuum interrupter and the changeover switch are in the correct position. However, as two positions of separate parts need to be inspected from which the position of the switch has to be derived, there is a substantial chance that a person misinterprets the positions.

SUMMARY

In an embodiment, the present invention provides a switch for medium voltage applications, wherein the switch comprises: a vacuum interrupter having: a fixed contact, a movable contact movable in a first direction to and away from the fixed contact between a closed position and an open position, and a drive rod arranged to the movable contact for moving the contact between the closed position and open position; a changeover switch having: a first terminal body, a second terminal body, an elongate pole body hinged with a first end to the first terminal body and rotatable between a connected position in which the second end of the pole body is in direct electrical contact with the second terminal body and a disconnected position in which the second end is disconnected from the second terminal body, and an operating rod hinged with one end to the elongate pole body and extending in substantially the first direction; wherein the first terminal body is fixedly arranged and in electrical contact with the movable contact, wherein a main marker is arranged on one of the drive rod and the operating rod, and in that two sets of at least two auxiliary markers are arranged on the other of the drive rod and the operating rod, wherein the two sets are spaced apart in the first direction with a first pitch distance, and wherein the at least two auxiliary markers of each set are spaced apart in the first direction with a second pitch distance, wherein the second pitch distance is smaller than the first pitch distance.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
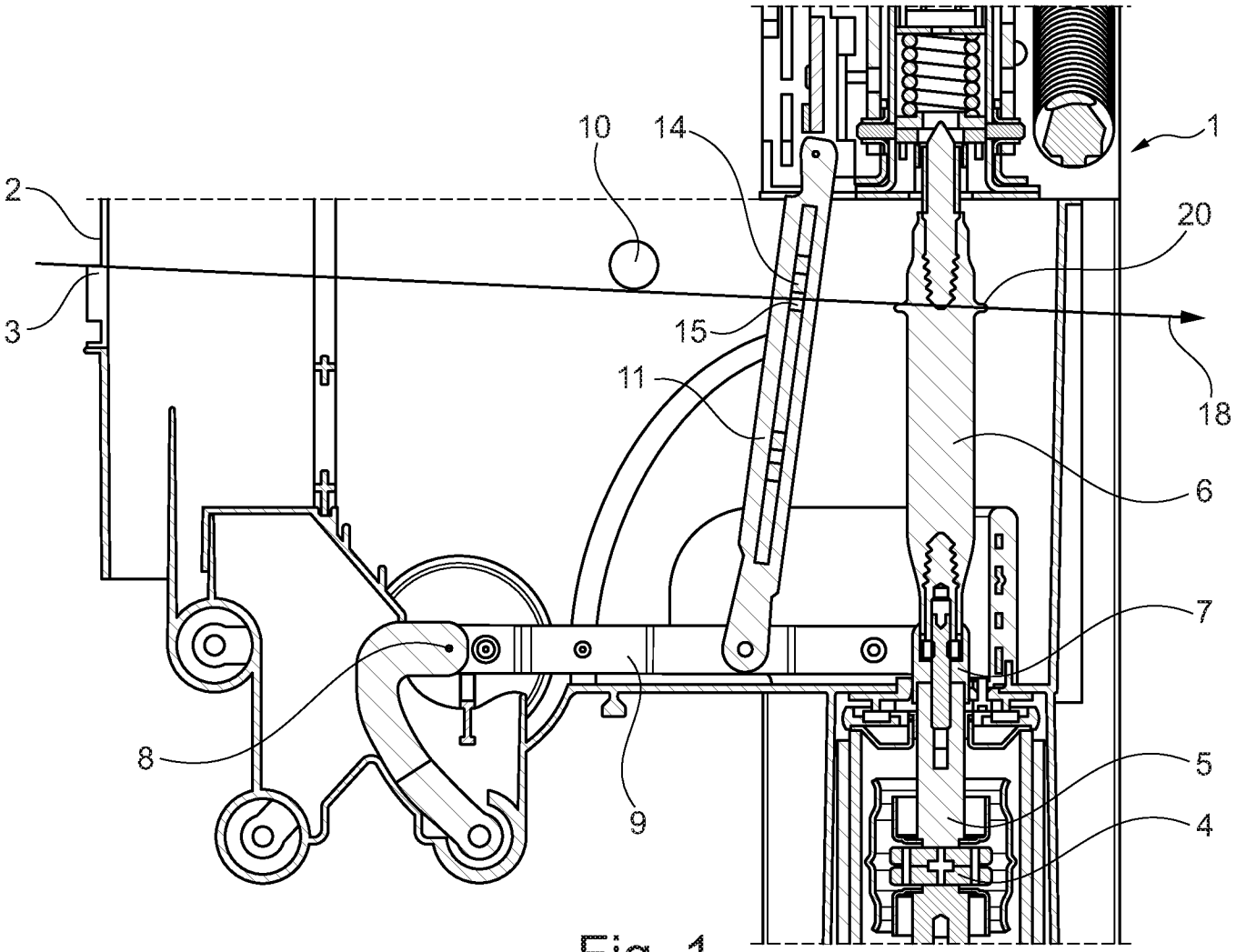
FIG. 1 shows a side view of a combination according to the invention in service position.

In an embodiment, the present invention provides a switch for medium voltage applications, the switch comprises: a vacuum interrupter having: a fixed contact, a movable contact movable in a first direction to and away from the fixed contact between a closed position and an open position, and a drive rod arranged to the movable contact for moving the contact between the closed and open position. The switch further comprises a changeover switch having: a first terminal body, a second terminal body, an elongate pole body hinged with a first end to the first terminal body and rotatable between a connected position in which the second end of the pole body is in direct electrical contact with the second terminal body and a disconnected position in which the second end is disconnected from the second terminal body, and an operating rod hinged with one end to the elongate pole body and extending in substantially the first direction; wherein the first terminal body is fixedly arranged and in electrical contact with the movable contact.

In an embodiment, the present invention provides a switch, which is characterized in that a main marker is arranged on one of the drive rod and the operating rod and in that two sets of at least two auxiliary markers are arranged on the other of the drive rod and the operating rod, wherein the two sets are spaced apart in the first direction with a first pitch distance, and wherein the at least two auxiliary markers of each set are spaced apart in the first direction with a second pitch distance, wherein the second pitch distance is smaller than the first pitch distance.

The combined position of the vacuum interrupter and the changeover switch has four possibilities: closed-connected, closed-disconnected, open-connected and open-disconnected. Because the drive rod and the operating rod are directly coupled to the position of the respective part, the relative movement between the drive rod and the operating rod has four distinctive relative positions. By providing a main marker on one of the drive rod and the operating rod and by providing two sets of at least two auxiliary markers, i.e. at least four auxiliary markers, on the other of the drive rod and the operating rod, it is possible to clearly indicate with the main marker in which of the four positions the switch is.

Typically, the stroke of the vacuum interrupter will be different from the stroke of the changeover switch. Therefore, two sets are provided which are arranged at a pitch distance corresponding with the larger of the two strokes, while the pitch distance between the auxiliary markers within a single set corresponding with the smaller of the two strokes.

It could be possible to have different pitch distances between auxiliary markers of different sets, depending on whether the operating rod moves perfectly parallel to the first direction and whether the main marker can be viewed along a virtual single angle independent from the position of the switch or must be viewed along two different angles depending from the position of the switch.

In a preferred embodiment of the switch according to the invention, the changeover switch further comprises an earth contact to which the second end of the pole body is in direct electrical contact in the disconnected position.

By connecting the changeover switch to earth, it is ensured that no dangerous voltage levels are present. As a result, maintenance personnel can safely maintain the switch according to the invention.

In a further preferred embodiment of the switch according to the invention, the main marker is arranged on the drive rod, wherein the two sets of at least two auxiliary markers are arranged on the operating rod and wherein the at least two auxiliary markers of the two sets are notches or openings arranged in the operating rod.

In this embodiment, an existing switch can easily be modified by providing a modified operating rod with notches or openings and using a feature on the drive rod of the vacuum interrupter as main marker. This feature can also be applied for example as sticker or a dot of paint.

The invention also relates to a combination of a housing and a switch accommodated in the housing, wherein a viewing window is arranged in the housing, wherein the viewing window has at least one viewing line directed at the main marker and wherein at least one auxiliary marker is in plain sight of the at least one viewing line.

Typically a housing, in which a switch according to the invention is accommodated, is provided with a viewing window to see the position of the vacuum interrupter and the position of the changeover switch. Now with the provided main marker and auxiliary markers, the position can be determined more easily and more reliable.

With the invention, it is also possible to indicate intermediate positions of the changeover switch in combination with the open and closed position of the vacuum interrupter by providing a third set of auxiliary markers.

FIG. 1 shows an embodiment of a combination 1 according to the invention. The combination 1 has a housing 2 with a viewing window 3. A switch according to the invention is arranged in the housing 2. This switch has a vacuum interrupter with a fixed contact 4 and a movable contact 5 to which a drive rod 6 is arranged. A flange 20 is arranged on the drive rod 6, which flange functions as main marker.

Figure 3:
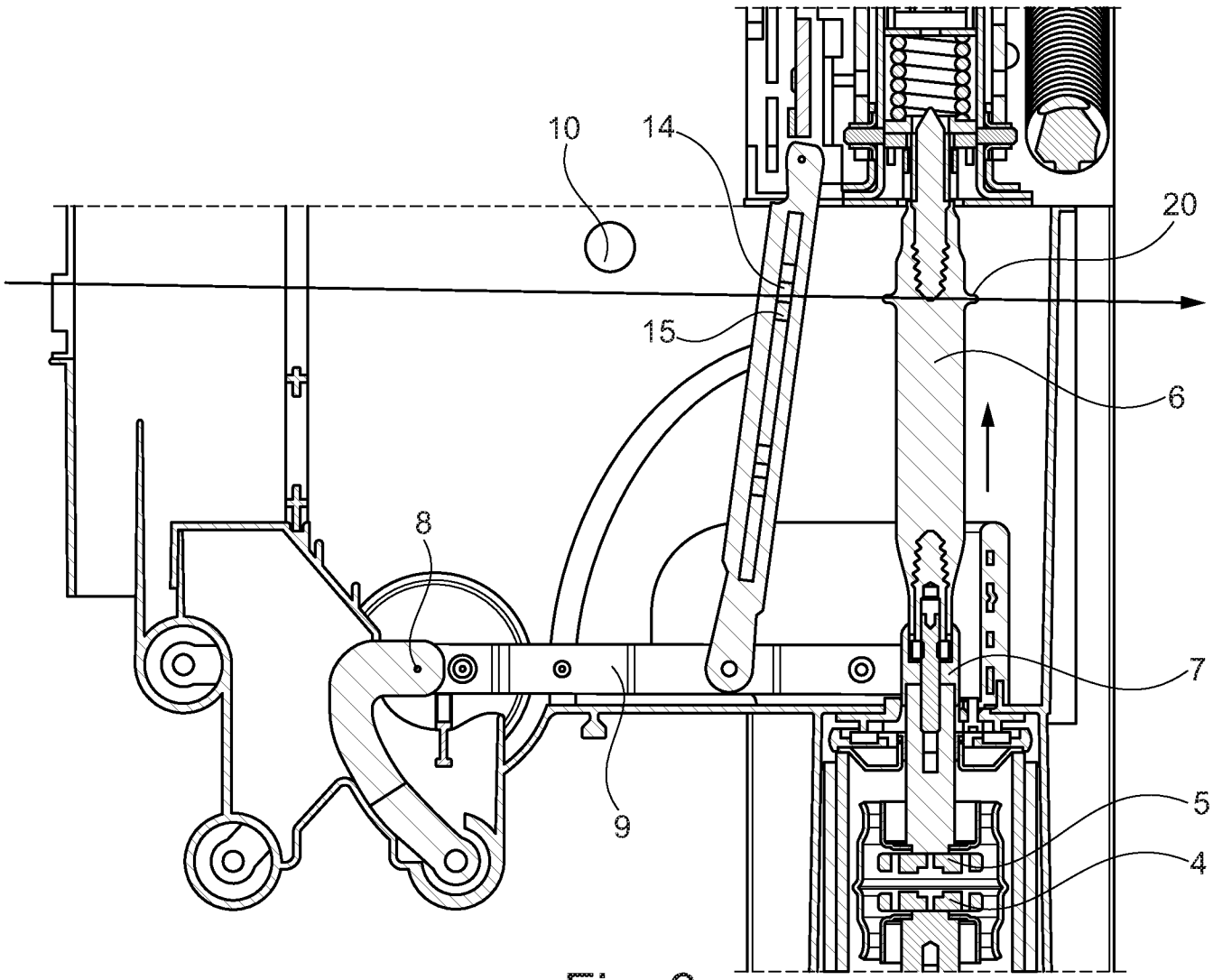
FIGS. 3-5 show the combination of FIG. 1 in three different positions.
Figure 4:
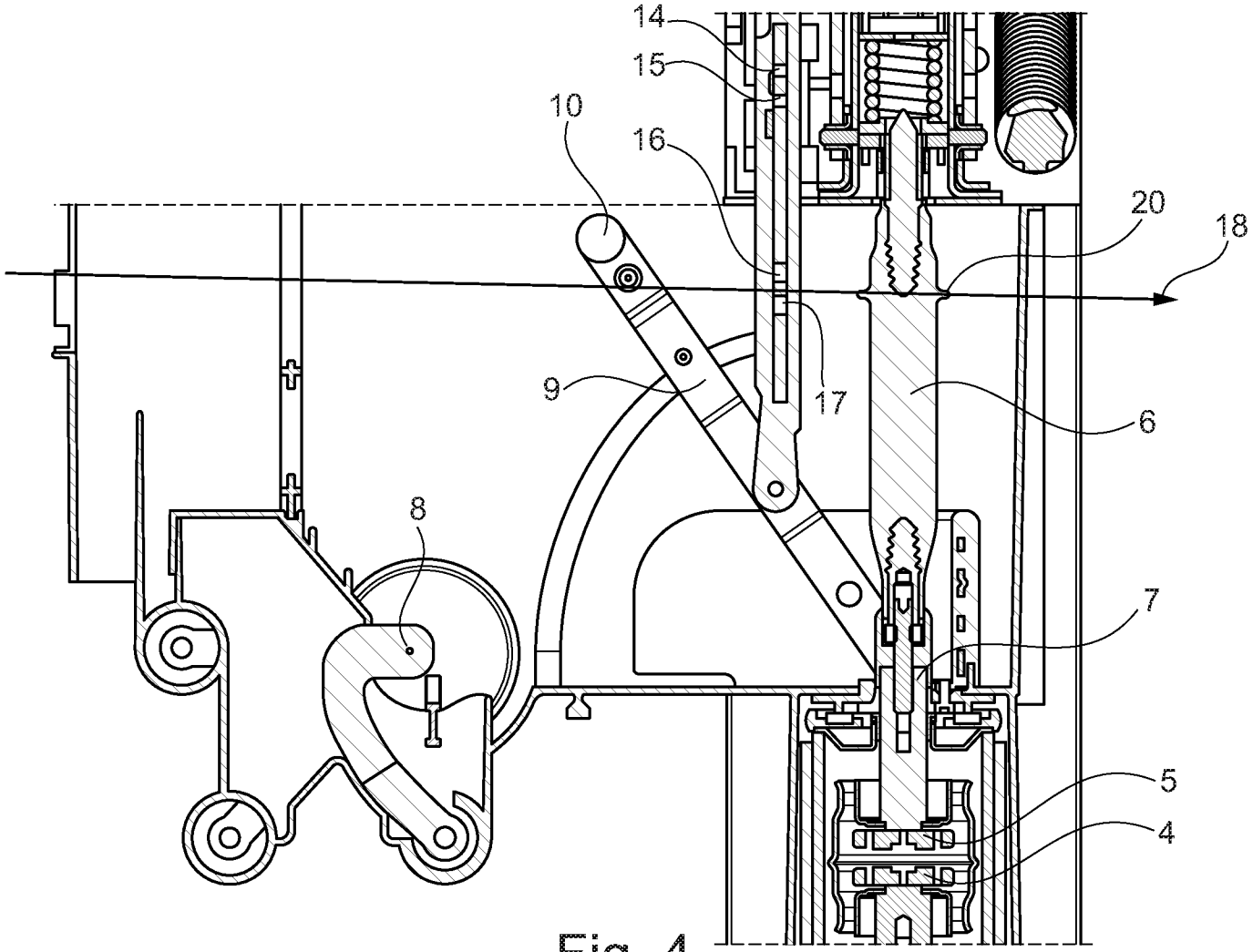
Figure 5:
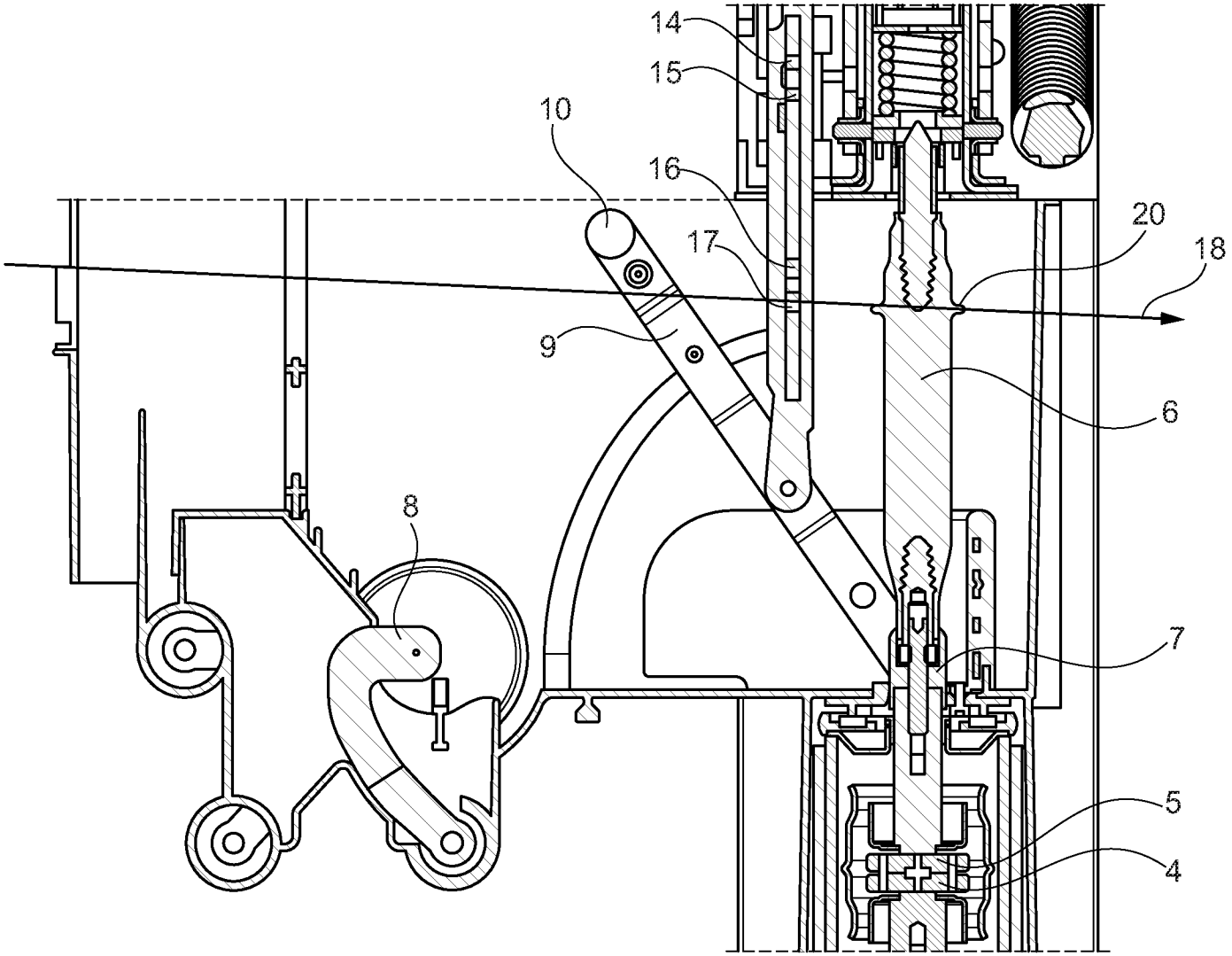

The switch further has a changeover switch with a first terminal body 7, a second terminal body 8, and an elongate pole body 9 which is hinged to the first terminal body 7 and rotatable from a connected position, as shown in FIGS. 1 and 3) to a disconnected position, as shown in FIGS. 4 and 5, wherein the elongate pole body 9 can connect with an earth contact 10.

Furthermore, an operating rod 11 is connected to the elongate pole body 9 for moving the elongate pole body from the connected position to the disconnected position.

Figure 2A:
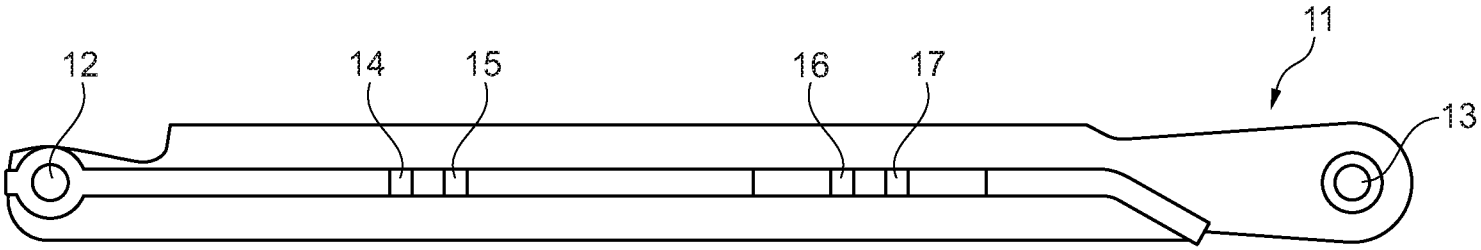
FIGS. 2A and 2B show side and top view respectively of an operating rod for a switch of the combination of FIG. 1.
Figure 2B:
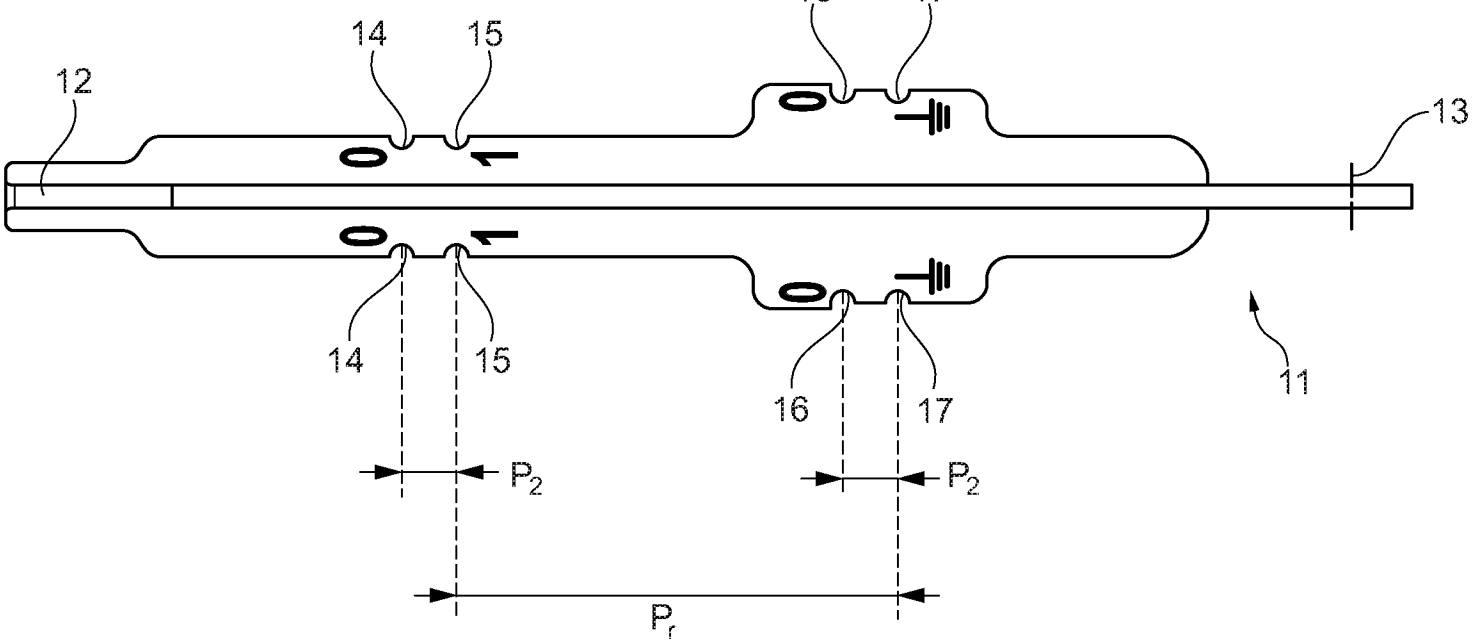

FIGS. 2A and 2B show the operating rod 11 in more detail. The operating rod 11 has a general plus-shaped cross-section for rigidity and two openings 12, 13. Along the longitudinal edges a first set of notches 14, 15 and a second set of notches 16, 17, which form auxiliary markers.

The notches 14, 15 and 16, 17 are arranged at a pitch distance $p_2$, while the two sets 14,15 and 16, 17 are arranged at a pitch distance $p_1$.

Referring back to FIG. 1, when the operating rod 9 is in the connected position, i.e. connecting the first terminal body 7 with the second terminal body 8 and the drive rod 6 is in the connected position, i.e. connecting the movable contact 5 with the fixed contact 4, the notch 15 is in the view line 18 such that the closed position of the vacuum interrupter can be registered in combination with the connected position of the changeover switch.

FIG. 3 shows the operating rod 9 still in connected position and wherein the drive rod 6 had moved the movable contact 5 to the open position. In this configuration, the view line 18 is aligned with the notch 14 and the flange 20.

In FIG. 4 the operating rod 9 is in the disconnected position, i.e. connecting the first terminal body 7 with the earth contact 10. The contacts 4 and 5 of the vacuum interrupter are still in the open position. In this configuration, the notch 16 is aligned with the view line 18 such that the closed position the open position of the vacuum interrupter in combination with the disconnected position of the changeover switch can be registered.

FIG. 5 shows the configuration, where the vacuum interrupter is in the closed position again, while the changeover switch is in the disconnected position. In this configuration, the notch 17 aligns with the flange 20 on the view line 18.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A switch for medium voltage applications, wherein the switch comprises:

a vacuum interrupter having:

a fixed contact, a movable contact movable in a first direction to and away from the fixed contact between a closed position and an open position, and a drive rod arranged to the movable contact for moving the contact between the closed position and open position;

a changeover switch having:

a first terminal body, a second terminal body, an elongate pole body hinged with a first end to the first terminal body and rotatable between a connected position in which the second end of the pole body is in direct electrical contact with the second terminal body and a disconnected position in which the second end is disconnected from the second terminal body, and an operating rod hinged with one end to the elongate pole body and extending in substantially the first direction;

wherein the first terminal body is fixedly arranged and in electrical contact with the movable contact, wherein a main marker is arranged on one of the drive rod and the operating rod, and in that two sets of at least two auxiliary markers are arranged on the other of the drive rod and the operating rod, wherein the two sets are spaced apart in the first direction with a first pitch distance, and wherein the at least two auxiliary markers of each set are spaced apart in the first direction with a second pitch distance, wherein the second pitch distance is smaller than the first pitch distance.

2. The switch according to claim 1, wherein the change-over switch further comprises an earth contact to which the second end of the pole body is in direct electrical contact in the disconnected position.

3. The switch according to claim 1, wherein the main marker is arranged on the drive rod, wherein the two sets of at least two auxiliary markers are arranged on the operating rod and wherein the at least two auxiliary markers of the two sets are notches or openings arranged in the operating rod.

4. The switch according to claim 1, wherein the switch is accommodated in a housing, wherein a viewing window is arranged in the housing, wherein the viewing window has at least one viewing line directed at the main marker, and wherein at least one auxiliary marker is in plain sight of the at least one viewing line.

* * * * *